United States Patent [19]

Awis

[11] 4,096,591

[45] Jun. 27, 1978

[54] DUAL FLUSH VALVE

[76] Inventor: Edward Adam Awis, 118 SW. 57th St., Cape Coral, Fla. 33904

[21] Appl. No.: 758,811

[22] Filed: Jan. 12, 1977

[51] Int. Cl.[2] ..... E03D 1/34

[52] U.S. Cl. ..... 4/326; 74/491

[58] Field of Search ..... 4/52, 56, 57 R, 57 P, 4/67 R, 67 A, DIG. 1; 74/22 R, 22 A, 63, 96, 491

[56] References Cited

U.S. PATENT DOCUMENTS

| | | | |
|---|---|---|---|
| 2,237,294 | 4/1941 | Easley | 4/37 |
| 2,731,647 | 1/1956 | Groth et al. | 4/67 A |
| 2,864,095 | 12/1958 | Martino | 4/67 A X |
| 3,877,082 | 4/1975 | Wilhelm | 4/67 A X |
| 3,913,149 | 10/1975 | Brinton | 4/67 A |
| 3,916,455 | 11/1975 | Longdin | 4/67 A |
| 4,025,967 | 5/1977 | Walker | 4/67 A X |

*Primary Examiner*—Richard E. Aegerter
*Assistant Examiner*—Stuart S. Levy
*Attorney, Agent, or Firm*—Clarence A. O'Brien; Harvey B. Jacobson

[57] ABSTRACT

A flush valve system for use in a flushing tank of a toilet has a pair of valve seats arranged at different levels within the tank. Valve elements normally blocking the valve seats are operated by a trip mechanism so as to unblock the valve seats independently of one another by turning the flush handle in opposite directions.

6 Claims, 5 Drawing Figures

62
52
18
58
54
26
14
70
68
50
44
38
56
48
60
S
40
12
32
46
42
34
28
34
22
24
30

26
52
18
62
56
58
54
60
14
70
38
44
12
68
36
42
28
S
32
34
22
30
24

58
52
56
54
70

DUAL FLUSH VALVE

BACKGROUND OF THE INVENTION

1. Field of the Invention

This invention relates generally to a flush valve system for use in a flushing tank of a toilet, and particularly to a flush valve system having two valves disposed at different levels in the flushing tank for permitting the toilet to be flushed with a small or larger amount of water as is necessary to evacuate the toilet bowl.

2. Description of the Prior Art

Toilet bowl flush systems have long been known which employ dual flush valves that permit one to select the amount of water used in a given flushing operation. Generally, these dual flush valves comprise a pair of independently operated valves one of which is at a higher level in the flushing tank than the other of the valves. Suitable actuator mechanisms are connected between the flush handle of the toilet and the valves for permitting one to operate one of the valves either by opposite rotation of the flush handle, or by twisting or pushing the flush handle, or by any other suitable arrangement.

Examples of known dual flush valve systems can be found in U.S. Pat. Nos: 2,505,091, issued Apr. 25, 1950 to E. L. Brebis; 2,685,694, issued Aug. 10, 1954 to J. R. Allison; 2,731,647, issued Jan. 24, 1956 to E. P. Groth et al; 2,839,759, issued June 24, 1958 to J. Martino; 2,864,095, issued Dec. 16, 1958 to J. Martino; 3,758,893, issued Sept. 18, 1973 to W. H. Smolinski et al; and 3,795,016, issued Mar. 5, 1974 to E. A. Eastman.

SUMMARY OF THE INVENTION

It is an object of the present invention to provide a dual flush valve of simple yet rugged and reliable construction.

It is another object of the present invention to provide a dual flush valve employing a trip mechanism of reliable construction for operating the valve elements of the valve system.

These and other objects are achieved according to the present invention by providing a flush valve system having: a pair of valve seats arranged at different levels in a flushing tank; a pair of valve elements, each mounted for normally blocking a respective one of the valve seats; and an actuator assembly operating on the valve elements for causing the valve elements to unblock the valve seats independently of one another.

The actuator assembly advantageously includes a lever pivotally mounted above the valve seats and having two oppositely directed arms, with one of the arms being connected to one of the valve elements for operating same. A crank affixed to the flush handle of the associated flushing tank for forming a lever with same is pivotally mounted on the tank and connected to the other of the valve elements for operating same. The crank is arranged for selectively engaging the other of the arms of the lever pivotally mounted above the valve seats for pivoting this lever in one direction of rotation of the associated flush handle.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
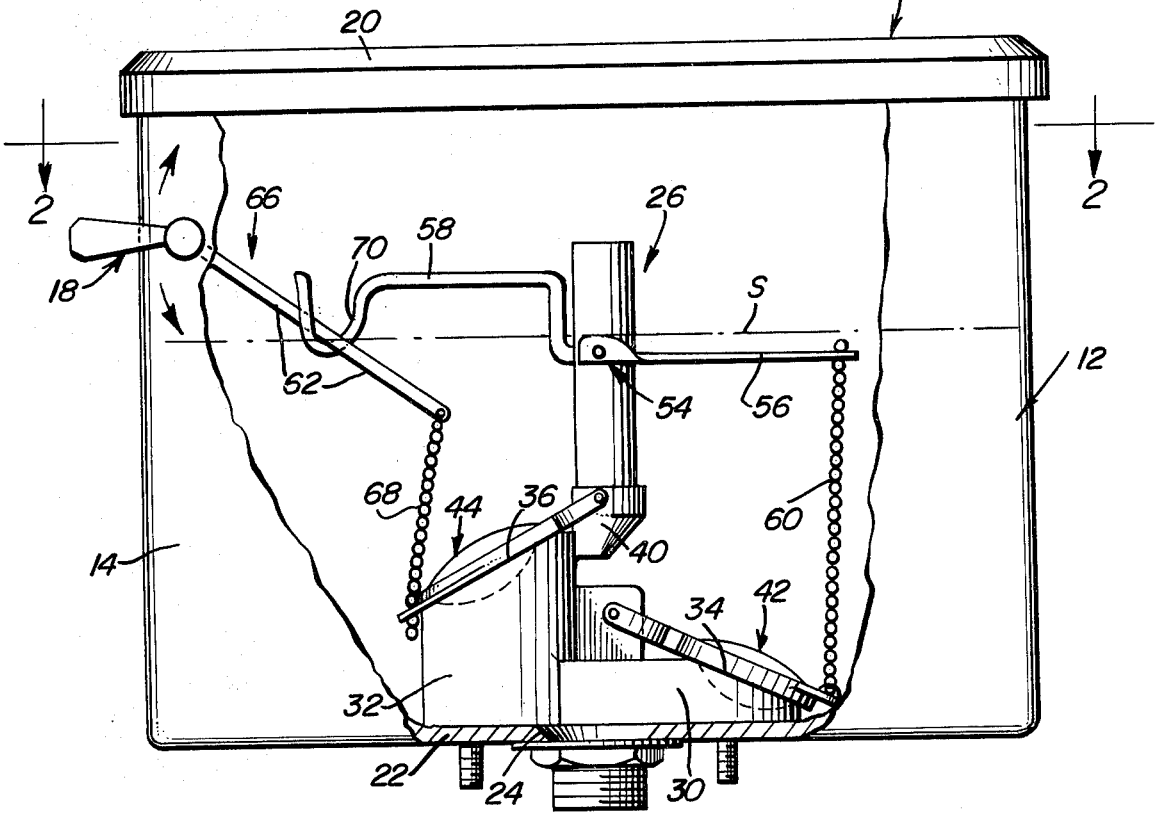
FIG. 1 is a front elevational view, partly cut away and in section, showing a flushing tank provided with a dual flush valve system according to the present invention.
Figure 2:
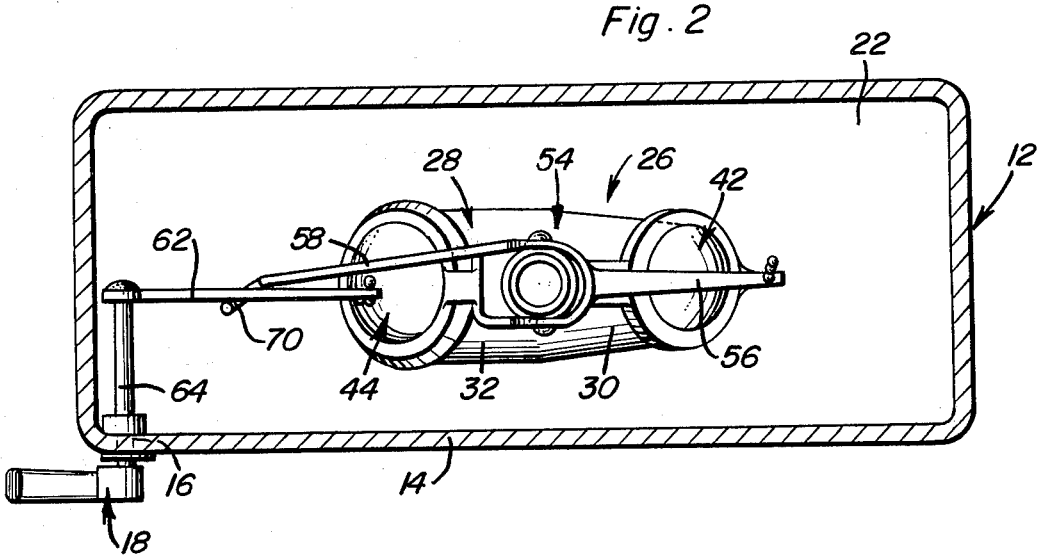
FIG. 2 is a sectional view taken generally along the line 2—2 of FIG. 1.

Referring now more particularly to the Figures. of the drawings, a toilet bowl flush assembly 10 has in the conventional manner a tank 12 provided with a front wall 14 having an aperture 16 formed therein for receiving a flush handle 18 rotatably mounted on wall 14 so as to pass through the aperture 16. A cover 20 is removably arranged over the top of tank 20 in the usual manner, while a bottom wall 22 of tank 12 is provided with an outlet opening 24 through which water from tank 12 is selectively discharged through a flush valve system. In the present invention, the flush valve system is in the form of a dual flush valve system 26.

The remainder of the elements, such as the inlet water shutoff valve assembly, has been omitted from the drawings. Since any conventional float valve, and the like, can be employed for this purpose, and since this structure does not form part of the present invention, a water inlet system for the flushing tank 12 will not be described herein.

Flush valve system 26 includes a housing 28 formed by a pair of ported sections 30 and 32 each in communication with the outlet opening 24 and terminating upwardly in respective valve seats 34 and 36 arranged at different levels in tank 12 relative to the bottom wall 22 thereof. An overflow tube 38 is connected to the upper portion of the section 32, adjacent the valve seat 36, as by the illustrated elbow 40.

A pair of valve elements 42 and 44 associated with the valve seats 34 and 36, respectively, so as to be normally against the seats 34, 36 and block the ports associated with sections 30 and 32. Each valve element 42, 44 includes a clevis 46, 48 pivotally mounted on the associated section 30 and the elbow 40, respectively, for permitting pivotal movement of the valve elements 42 and 44 toward and away from the associated seats 34, 36. An actuator assembly 50 operates on valves elements 42, 44 for causing the valve elements 42, 44 to unblock the associated valve seats 34, 36 independently of one another.

Figure 3:
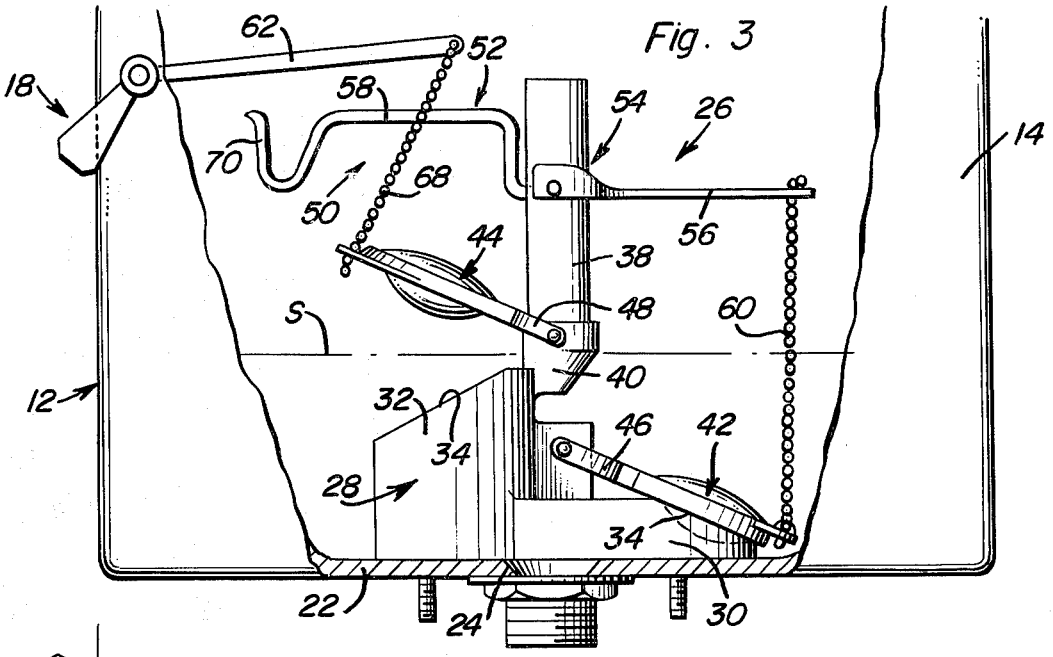
FIG. 3 is a fragmentary, front elevational view, partly broken away and in section, similar to FIG. 1, but showing the flush valve system in a different stage of operation.
Figure 4:
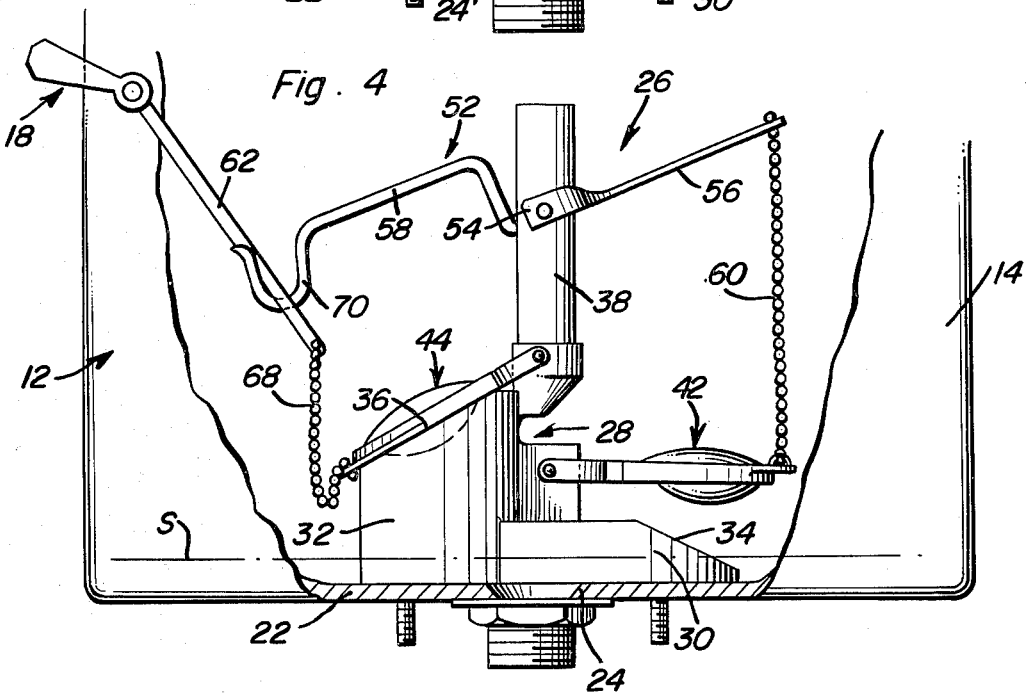
FIG. 4 is a front elevational view, partly cut away and in section, similar to FIGS. 1 and 3, but showing the flush valve system in yet another stage of operation.
Figure 5:
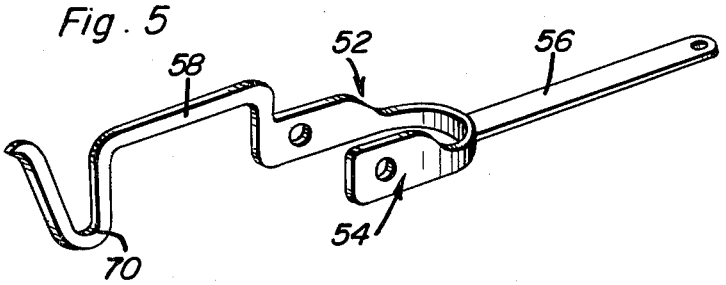
FIG. 5 is a perspective view showing part of the trip mechanism of a flush valve system according to the present invention.

Actuator assembly 50 includes a lever 52 pivotally mounted on overflow tube 38 above the valve seats 34 and 36 as by a clevis 54 provided in the mid-portion of lever 52. Arms 56 and 58 extend in opposite directions from clevis 54, with the arm 58 being offset from the plane of arm 56 in the direction away from the valve seats 34, 36. Arm 56 is connected by a chain 60 to the free end of the flapper valve element which forms the valve element 42 so as to selectively pivot valve element 42 away from its associated valve seat 34 and unblock the latter. This position is shown in FIG. 4. A crank 62 is affixed to the inner end of a shaft 64 of flush handle 18 for forming a flush lever 66 in cooperation with handle 18. By this arrangement, crank 62, which is attached directly to the free end of the flapper valve element forming the valve element 44 by a chain 68 for moving valve element 44 to a position unblocking the valve seat 34 as shown in FIG. 3, can be swung either clockwise or counterclockwise as seen in FIGS. 1, 3 and 4, in order to selectively actuate the valve elements 42 and 44.

More specifically, crank 62 is arranged for selectively engaging arm 56 at a generally U-shaped portion 70 thereof for pivoting lever 52 in the manner shown in FIG. 4. Portion 70 opens away from the valve seats 32, 34, so that when crank 62 is swung in the counter-clockwise direction, as shown in FIG. 3, valve element 42 will remain blocking associated valve seat 32. The valve element 44, however, will be pulled away from its associated valve seat 34 in order to unblock the same. Accordingly, as can be seen from FIGS. 1, 3 and 4, both valve elements 42, 44 are arranged blocking their respective seats 34, 36 as seen in FIG. 1. If flush handle 18 is rotated clockwise as indicated by the direction arrow in FIG. 1, the crank 62 will be also moved clockwise so as to engage the U-shaped portion of arm 58 and cause lever 52 to be pivoted in a clockwise direction as shown in FIG. 4. If, on the other hand, the flush lever 18 is pivoted in the counter-clockwise direction as indicated by the arrow of FIG. 1, crank 62 will disengage from the U-shaped portion 70 of arm 58 so as to leave the lever 52 in its normal position, but will cause the valve element 44 to be drawn away from its associated valve seat 34 as shown in FIG. 3 in order to cause a minimum flushing action of the flush assembly 10. Movement of the valve element 42 away from associated valve seat 34 will cause a maximum flushing action of the flush assembly 10. The level of water or other suitable liquid in tank 12 is shown by the broken line designated S in FIGS. 1, 3 and 4.

As can be appreciated from the above description of the drawings, a dual flush valve system according to the present invention permits maximum and minimum flushing in a simple yet rugged and reliable manner by oppositely directive movements of the flush handle. By this arrangement, substantial savings in water consumption can be realized without inconvenience to the persons using the flush assembly.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A flush valve system for use in a flushing tank of a toilet, comprising, in combination:

(a) a pair of valve seats arranged at different levels in a liquid reservoir;

(b) a pair of valve elements, each mounted for blocking a respective one of the valve seats; and (c) actuator means operating on the valve elements for causing the valve elements to unblock the valve seats independently of one another, the actuator means including in combination:

(1) a lever pivotally mounted on a pivot axis disposed between and above the valve seats, the lever having two oppositely directed arms each arranged for moving toward and away from an associated one of the valve seats, with one of the arms being connected to one of the valve elements for operating same and moving the valve element to a position unblocking the associated one of the valve seats; and (2) a crank separate from and operable independently of the lever, the crank pivotally mounted on the liquid reservoir substantially coextensive with the lever, the crank and lever pivoting on parallel axes, and connected to the other of the valve elements for operating same in a first direction of rotation of the crank, the crank being arranged for selectively engaging the other of the arms of the lever in a second direction of rotation of the crank opposite to the first direction for pivoting the lever and causing the one of the valve elements to unblock the associated one of the valve seats wherein the other of the arms of the lever terminates in a U-shaped portion opening away from the valve seats and bent from the extent of the lever for engaging with the crank, the crank engaging the U-shaped portion in the second direction of rotation and pivoting the lever thereby for operating the one of the valve elements, and the crank moving away from and out of engagement with the U-shaped portion of the lever in the first direction of rotation while simultaneously operating the other of the valve elements and unblocking the other of the valve seats.

2. A structure defined in claim 1, wherein the valve seats are connected together, and the valve system further including an overflow tube mounted on a one of the valve seats arranged at a level higher than the other of the valve seats and extending upwardly away from the valve seats, the lever including a clevis arranged partially around the overflow tube and pivotally mounted on the overflow tube for being supported above the valve seats.

3. A structure defined in claim 1, wherein the valve seats are connected together, and the valve system further including an overflow tube mounted on a one of the valve seats arranged at a level higher than the other of the valve seats and extending upwardly away from the valve seats, the lever including a clevis arranged partially around the overflow tube and pivotally mounted on the overflow tube for being supported above the valve seats.

4. In a toilet bowl flush assembly including a tank provided with a wall having an aperture formed therein for receiving a flush handle, a flush handle rotatably mounted on the wall and in the aperture formed therein, a cover removably arranged on the tank, with the tank having a bottom wall provided with an outlet opening, and a flush valve system arranged in the tank in communication with the outlet opening, the improvement wherein the flush valve system comprises, in combination:

(a) a pair of valve seats arranged in the tank at different levels from the bottom wall of the tank;

(b) a pair of valve elements each mounted for normally blocking a respective one of the valve seats; and (c) actuator means connected to the flush handle and operating on the valve element for causing the valve elements to unblock the valve seats independently of one another, the actuator means including, in combination:

(1) a lever pivotally mounted on a pivot axis disposed between and above the valve seats, the lever having two oppositely directed arms each arranged for moving toward and away from an associated one of the valve seats about a pivot axis of the lever, with one of the arms being connected to one of the valve elements for operating same and moving the valve element to a position unblocking the associated one of the valve seats; and (2) a crank separate from and operable independently of the lever, the crank pivotally mounted on the liquid reservoir substantially coextensive with the lever, the crank and lever pivoting on parallel axes, and connected to the other of the valve elements for operating same in a first direction of rotation of the crank, the crank being arranged for selectively engaging the other of the arms of the lever in a second direction of rotation of the crank opposite to the first direction for pivoting the lever and causing the one of the valve elements to unblock the associated one of the valve seats wherein the other of the arms of the lever terminates in a U-shaped portion away from the valve seats and bent from the extent of the layer for engaging with the crank, the crank engaging the U-shaped portion in the second direction of rotation and pivoting the lever thereby for operating the one of the valve elements, and the crank moving away from and out of engagement with the U-shaped portion of the lever in the first direction of rotation while simultaneously operating the other of the valve elements and unblocking the other of the valve seats.

5. A structure defined in claim 4, wherein the valve seats are connected together, and the valve system further including an overflow tube mounted on a one of the valve seats arranged at a level higher than the other of the valve seats and extending upwardly away from the valve seats, the lever including a clevis arranged partially around the overflow tube and pivotally mounted on the overflow tube for being supported above the valve seats.

6. A structure defined in claim 4, wherein the valve seats are connected together, and the valve system further including an overflow tube mounted on a one of the valve seats arranged at a level higher than the other of the valve seats and extending upwardly away from the valve seats, the lever including a clevis arranged partially around the overflow tube and pivotally mounted on the overflow tube for being supported above the valve seats.

* * * * *